US008146188B2

(12) United States Patent
Hibler

(10) Patent No.: US 8,146,188 B2
(45) Date of Patent: Apr. 3, 2012

(54) ENVIRONMENTALLY SAFE ADJUSTABLE BED

(76) Inventor: Jeffrey Lynn Hibler, Fort Wayne, IN (US)

( * ) Notice: Subject to any disclaimer, the term of this patent is extended or adjusted under 35 U.S.C. 154(b) by 231 days.

(21) Appl. No.: 12/454,411

(22) Filed: May 18, 2009

(65) Prior Publication Data

US 2010/0287704 A1 Nov. 18, 2010

(51) Int. Cl.
*A61G 7/015* (2006.01)

(52) U.S. Cl. ..... 5/613; 5/617; 5/618

(58) Field of Classification Search ..... 5/613–618, 5/740

See application file for complete search history.

(56) References Cited

U.S. PATENT DOCUMENTS

| | | | | |
|---|---|---|---|---|
| 2,631,300 | A * | 3/1953 | Murray | 5/616 |
| 3,447,170 | A * | 6/1969 | Spitz | 5/722 |
| 4,095,296 | A * | 6/1978 | Ferro | 5/616 |
| 5,170,522 | A * | 12/1992 | Walker | 5/615 |
| 5,568,677 | A | 10/1996 | Tobin | |
| 6,306,997 | B1 * | 10/2001 | Kuo et al. | 527/100 |
| 6,708,358 | B2 * | 3/2004 | Hensley | 5/915 |
| 6,951,037 | B2 * | 10/2005 | Weinman et al. | 5/618 |
| 7,252,735 | B2 * | 8/2007 | Li | 156/330 |
| 7,322,058 | B2 | 1/2008 | Long | |
| 7,465,280 | B2 | 12/2008 | Rawls-Meehan | |
| 7,736,559 | B2 * | 6/2010 | Rivers et al. | 264/109 |
| 2008/0127418 | A1 | 6/2008 | Rawls-Meehan | |

* cited by examiner

*Primary Examiner* — Michael Trettel

(57) ABSTRACT

An adjustable bed having an adjustable bed frame and a first actuator and a second actuator each attached to the frame. A mattress platform is secured to the bed frame. The first and second actuators are secured to the mattress platform. The mattress platform is constructed from chemical free material, whereby the adjustable bed is environmentally safe.

20 Claims, 3 Drawing Sheets

ENVIRONMENTALLY SAFE ADJUSTABLE BED

BACKGROUND OF THE INVENTION

1. Field of the Invention

The present invention relates to adjustable beds used in residential homes, nursing homes, assisted living centers, sleep centers, hospitals and the like that are environmentally safe containing no chemicals such as formaldehyde.

2. Description of the Related Art

The present invention relates adjustable beds have been available for personal use in homes, as well as in medical environments. These beds are mechanical in that the head and the foot of the beds raise and lower to enable repositioning of a persons body. The head and foot can be raised to help with medical ailments or simply convenience when reading or watching television.

These types of beds are conventionally construction from plywood and synthetically made foam both of which contain hazardous chemicals such as formaldehyde. Chemicals like formaldehyde are in several common everyday use products like clothing made from synthetic materials, cosmetics, cleaning products, antiperspirants, hair spray as many other products. Formaldehyde can be absorbed through the skin or through mucous membranes in the nose and mouth. Such chemicals have an adverse affect on people causing a variety of symptoms including upper respiratory problems.

An adjustable bed is conventionally constructed from products having formaldehyde in them, i.e. a mattress support platform. The mattress support platform is typically constructed from common use plywood which contains formaldehyde. Additionally, foams such as High Resolution (HR) high density foam are used as padding on top of the mattress support platform and as a layer in mattresses used with the adjustable bed. The mattress may have a cover that is constructed from synthetic materials containing chemicals.

Particularly when a person spends on average eight (8) hours a day in bed, a person is exposed to hazardous chemicals that can be damaging. The prior art does not provide an adjustable bed that is constructed from chemical free components.

SUMMARY OF THE INVENTION

An adjustable bed having an adjustable bed frame. A first actuator and a second actuator are each attached to the frame. A mattress platform is secured to the bed frame with the first and second actuators being secured to the mattress platform. The mattress platform is constructed from chemical free material, whereby the adjustable bed is environmentally safe.

Accordingly, it is a further object of the present invention that the mattress platform is constructed from formaldehyde free plywood.

It is a further object of the present invention that the formaldehyde free plywood is manufactured using soy glue.

It is still a further object of the present invention that the mattress platform is constructed from formaldehyde free medium density fiberboard.

Additionally, it is a further object of the present invention to provide deck foam positioned atop the mattress platform, wherein the deck foam is all natural foam.

It is still a further object of the present invention that the deck foam is one of latex foam or soy based foam.

It is a further object of the present invention that the deck foam is covered by a deck cover, the deck cover constructed from all natural fiber material.

It is also a further object of the method of the present invention to provide a mattress placed atop the deck foam, wherein the mattress is one of latex foam or soy based foam.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
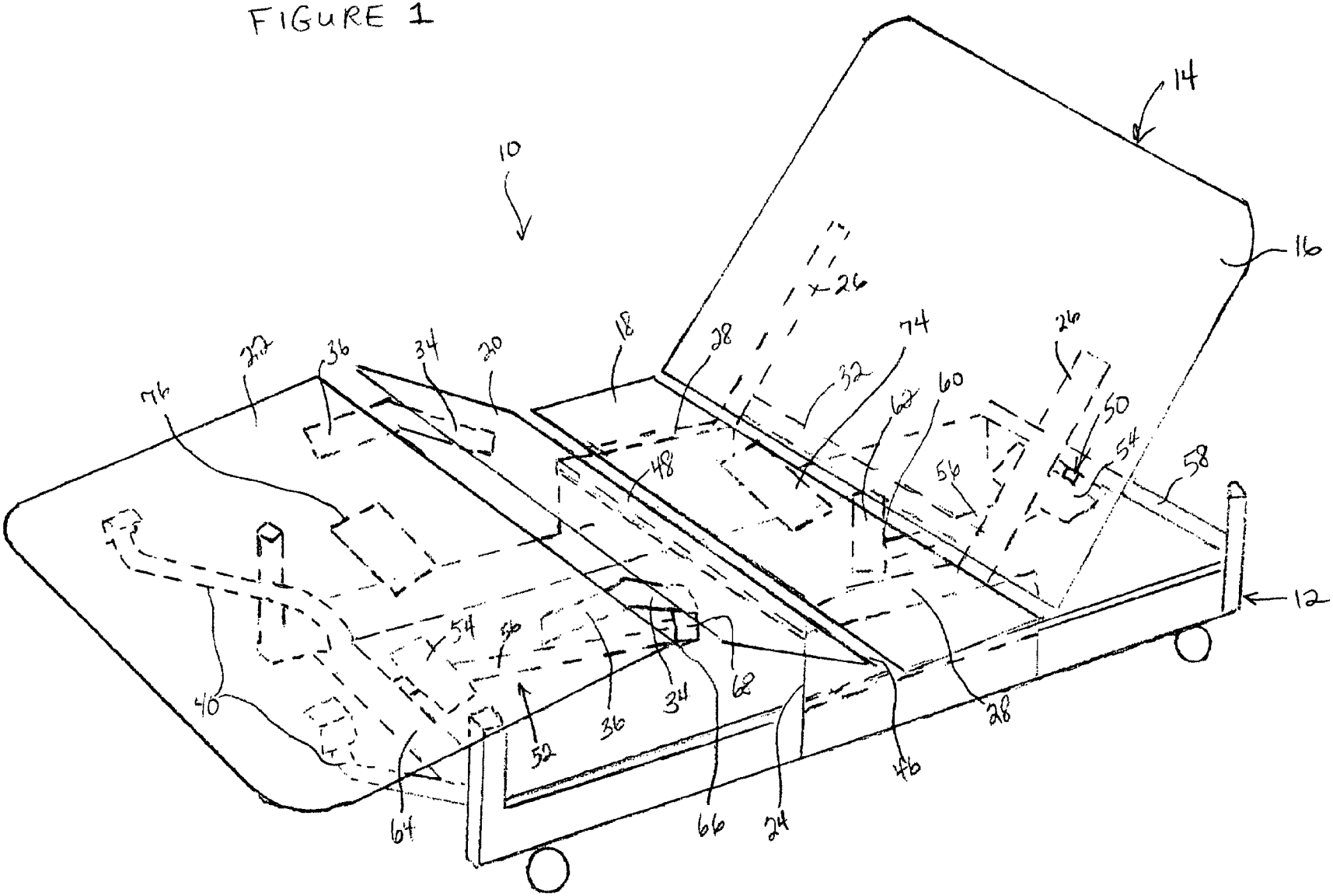
FIG. 1 is a perspective view of an adjustable bed in accordance with the present invention.

Corresponding reference characters indicate corresponding parts throughout the several views. Although the exemplification set out herein illustrates the invention, the embodiments disclosed below are not intended to be exhaustive or to be construed as limiting the scope of the invention to the precise forms disclosed.

DESCRIPTION OF THE PRESENT INVENTION

Figure 2:
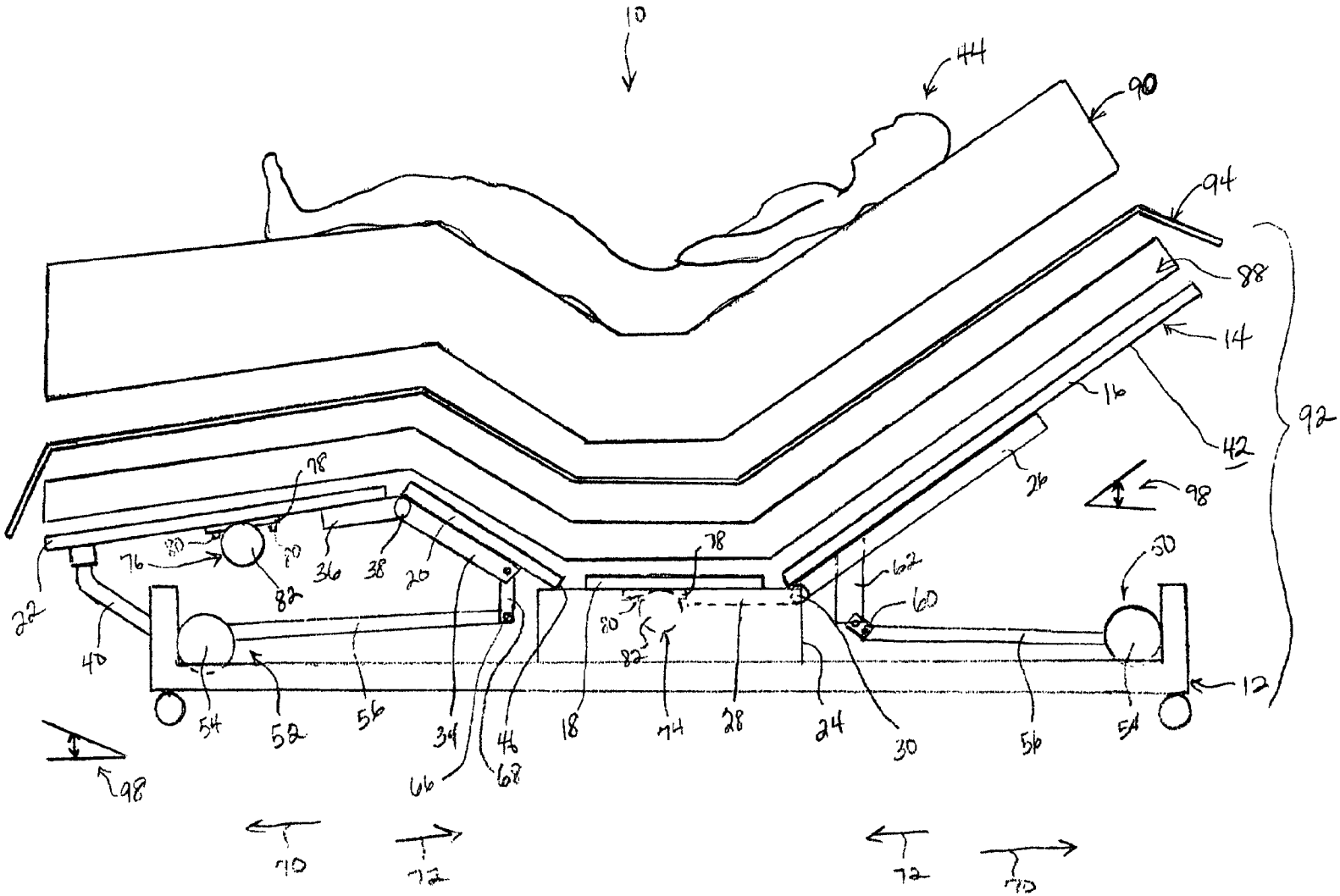
FIG. 2 is an exploded plan view of the adjustable bed of FIG. 1 illustrating the adjustable bed and mattress in combination with the head and foot raised in accordance with the present invention.

Adjustable bed 10 illustrated in FIGS. 1 and 2 in accordance with the present invention is constructed from chemical free products. By using chemical free products, adjustable bed 10 is environmentally safe and thus safe for people to use. The elimination of chemicals, like formaldehyde, from the materials used to construct adjustable bed 10 can prevent symptoms such as upper respiratory problems.

Referring to FIGS. 1 and 2, adjustable bed 10 is illustrated in accordance with the present invention. Adjustable bed 10 is comprised of frame 12 to which the components of adjustable bed 10 are mounted and on which mattress platform 14 is supported. Adjustable bed frame 12 is construction from a material able to support weight of the bed and person up to 600 pounds such as steel, or the like.

Mattress platform 14 includes four sections, head section 16, center section 18, first foot section 20, and second foot section 22. The mattress platform is typically constructed from standard flat wood materials such as plywood. However, plywood contains chemicals that are hazardous to people and are not environmentally safe due to glues used when laminating the layers of the plywood are assembled. Thus, in accordance with the present invention, mattress platform 14 of adjustable bed 10 is constructed from a natural, chemical free material. In one embodiment, mattress platform 14 is constructed from formaldehyde free plywood. The chemical free plywood is manufactured using soy glue which is all natural and environmentally safe. Alternatively, a formaldehyde free medium density fiberboard (MDF) may be used for mattress platform 14.

Figure 3:
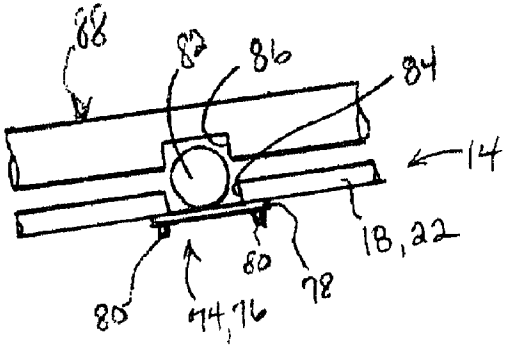
FIG. 3 is an exploded plan view of a portion of the adjustable bed of FIG. 2 illustrating an alternative mounting method of a massage motor in accordance with the present invention.

Center section 18 is stationary being securely mounted to plates 24 of frame 12 by typical means such as fasteners, or the like. Head section 16 is pivotally mounted to frame plates 24. A pair of head supports 26 are secured directly to head section 16 by fasteners, for example. A second pair of head supports 28 are affixed to plates 24. Hinges shown in FIG. 3 are then used to pivotally attach head supports 26 and 28. Hinges 30 may be a conventional hinge or a bolt passed though both head supports 26 and 28. Head supports 28 are then secured by fasteners, or the like, to frame plates 24. Hinges 30 allow head section 16 to move up and down as adjustable bed 10 is operated. Linking member 32 is securely attached at opposite ends to both head supports 26 for added strength in head section 16.

As shown in FIGS. 1 and 2, foot sections 20 and 22 are pivotally mounted to one another by foot supports 34 and 36. A pair of foot supports 34 are fixedly attached to first foot section 20 and a pair of foot supports 36 are fixedly attached to second foot section 20. Foot supports 34 and 36 are secured to foot sections 20 and 22 by any conventional method including fasteners, or the like. Foot supports 34 and 36 are pivotally attached at connecting ends by hinges 38 (FIG. 2). Hinges 38 may be a conventional hinge or a bolt passed though both foot supports 34 and 36. Angle supports 40 are secured to frame 12 and lower surface 42 (FIG. 2) of mattress platform 14 at foot section 22 to provide additional support of the end of foot section 22 such as if a person 44 were to sit on the end of adjustable bed 10, for example.

Edge 46 of foot section 20 is supported against frame plates 24 when foot sections 20 and 22 are raised (FIG. 2). When foot sections 20 and 22 are lowered into a flat position such that foot sections 20 and 22 are parallel to the ground, edge 46 lays atop cross bar 48 illustrated in FIG. 2. Cross bar 48 is fixedly attached at either end to frame plates 24 and supports edge 46 of foot section 20 of mattress platform 14.

Referring to FIGS. 1 and 2, first and second actuators 50 and 52 are located at opposite ends of frame 12. In one embodiment, actuators 50 and 52 are a piston type device. Motor 54 is attached to piston 56 which extends outward away from motor 54 and inward toward motor 54 to facilitate raising and lowering of head section 16 and foot sections 20 and 22.

First actuator 50 is mounted to cross member 58 at a first end of frame 12 by any suitable means including being welded, fastened with fasteners, or the like. Opposite end 60 of first actuator 50 is pivotally attached to head actuating member 62. The opposite end of actuating member 62 is fixedly secured to linking member 32 by any suitable means including welds or fasteners.

Second actuator 52 is mounted to cross member 64 at a second end of frame 12 by any suitable means including welding, fastening with fasteners, or the like. Opposite end 66 of second actuator 52 is pivotally attached to foot actuating member 68 which is also pivotally attached to foot support member 36.

First and second actuators 50 and 52 are electrically operated to raise and lower head section 16 and sections 20 and 22, respectively. When actuators 50 and 52 are drawn in, in the direction of arrow 70 (FIG. 2), head section 16 and foot sections 20 and 22 are raised from a flat position in which mattress platform 14 is parallel to the ground to a raised position illustrated in FIGS. 2 and 3. As actuators 50 and 52 are extended in the direction of arrow 72 (FIG. 2), head section 16 and foot sections 20 and 22 are lowered back to a flat position in which mattress platform 14 is parallel with the ground.

The locations of actuators 50 and 52 is beneficial to adjustable bed 10. First, by locating actuators 50 and 52 at respective ends 60 and 66 of frame 12, the mechanical load on the actuators is reduced. This allows adjustable bed 10 to have a higher weight capacity increasing the usability of the bed to persons that weight up to 600 pounds. Secondly, the location of actuators 50 and 52 creates more room underneath mattress platform 14. This allows more versatility when positioning optional massage motors 74 and 76 on mattress support platform 44 as will be described in greater detail below.

An optional feature of adjustable bed 10 is first and second massage motors 74 and 76. These motor are therapy motors that are designed to increase circulation in the body. The increase in circulation has been proven to improve health. They have a multi-directional cycloid motion created by three-way action. Massage motors 74 and 76 are typically constructed electric motors with magnets therein that when energized cause movement of armatures. In order to create the multi-directional motion, the armatures are weighted such that when motors 74 and 76 are operated, the motors provide therapy massage rather than simply vibrations or buzzing sensation. Motors 74 and 76 are encased in a plastic housing to prevent the user from coming into contact with the operating motor.

As shown in FIG. 2, massage motors 74 and 76 are provided with flange 78 that are used to attach the motors to lower surface 42 of center section 18 and foot section 22. Fasteners 80 pass through flange 78 and into the plywood of mattress platform 14. Alternatively, as shown in FIG. 3, mattress motors 74 and 76 are still mounted to lower surface 42 of mattress platform 14. However, body 82 of motors 74 and 76 extends through opening 84 in mattress platform 14 and opening 86 in deck foam 88 described further below.

As illustrated in FIGS. 1 and 2, the location of massage motors 74 and 76 on mattress platform 14 improves circulation by forcing blood flow from the extremities back to the heart to be oxygenated. In the present invention, massage motor 74 is located in center section 18 providing therapy to the often ailed lower lumbar region of person 44. This positioning of massage motor 74 is thus more beneficial to person 44 than positioning a buzzing motor behind the head as in the prior art. Massage motor 76 is located in foot section 22 of mattress platform 14 below the legs of person 44 which again soothes aching legs and forces circulation of blood from the extremities back to the heart.

Referring to FIG. 2, the composition of mattress 90 is an important component of the environmentally safe characteristic of adjustable bed 10. Mattress 90 is constructed from all natural materials such as latex or soy based foam. Latex is an all natural rubber that has no harmful chemicals.

Figure 4:
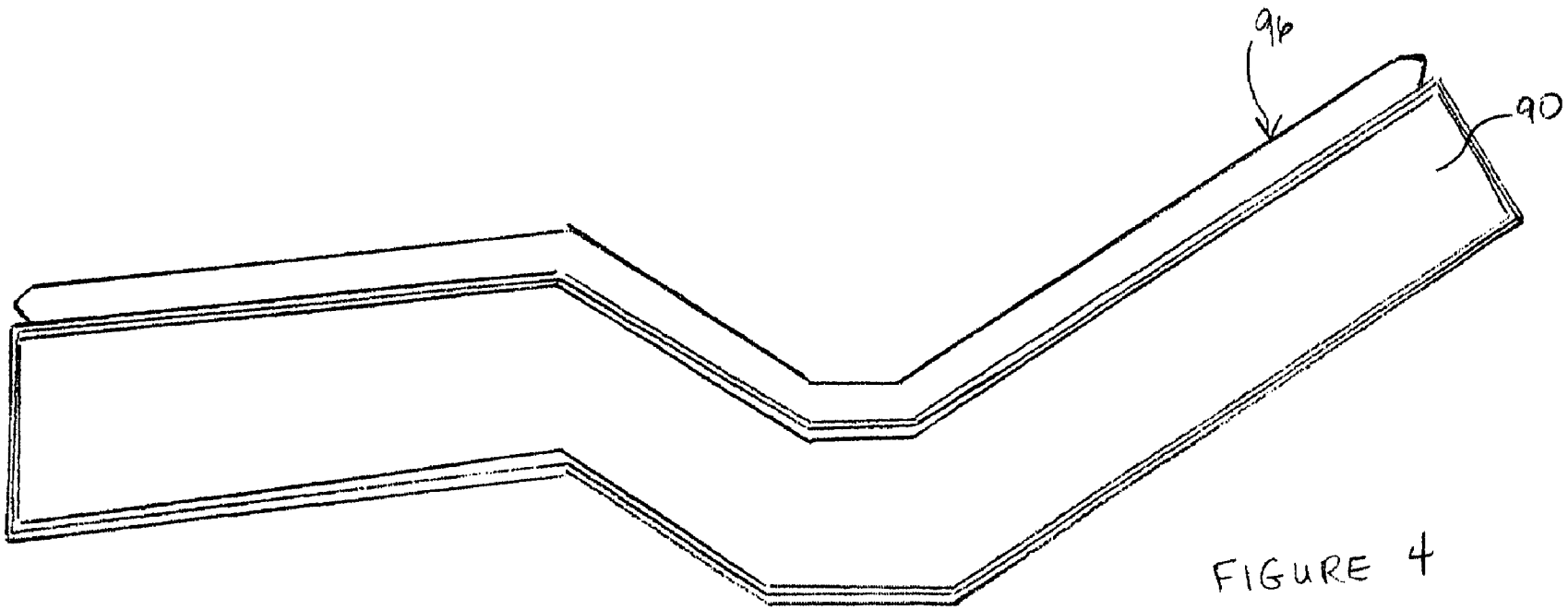
FIG. 4 is a plan view of a mattress in accordance with the present invention having a removable pillow top cover thereon.

Assembly of adjustable bed 10 is illustrated in detail in FIG. 2. As described above, adjustable bed 10 includes base 92 that is made up of frame 12, mattress platform 14, first and second actuators 50 and 52, and first and second massage motors 74 and 76. Located atop base 92 is deck foam 88 which is a layer of all natural foam. The foam is an all natural material and is not chemical based. Deck cover 94 is placed over deck foam 88 and wrapped underneath mattress platform 14 where it is removably attached to lower surface 42 of the platform with fasteners such as staples. Deck cover 94 is made from a quilted fabric material of natural fibers such as silk, wool, cotton, or the like. No synthetic materials are used to make deck cover 94. Deck cover 94 is used to simply aesthetically cover deck foam 88 and mattress platform 14. Mattress 90 is then laid atop base 92. Referring to FIG. 4, mattress 90 may alternatively be provided with a mattress cover 96 that encases mattress 90. The mattress cover has an added pillow top filled with an all natural fiber fill for added comfort. Mattress cover 96 is made from a quilted material similar to that of deck cover 94 in that it is a natural fiber material. The pattern of mattress cover 96 matches that of deck cover 94. By using mattress cover 96 on mattress 90, heat transfer from the bed to person 44 is reduced. Mattress cover 96 is may also be removable and cleanable. A wireless or wired controller (not shown) is linked to adjustable bed 10 to operate the functions of the bed including raising and lowering head section 16 and foot sections 50 and 52 of mattress platform 14, and operate massage motors 74 and 76. The controller may also have a timer function.

The purpose of adjustable bed 10 is that head section 16 and foot sections 50 and 52 can raise and lower to create a comfortable and beneficial position for person 44 shown in FIG. 2. Adjustable bed 10 can be positioned such that person 44 can lay in bed and read or watch television. Further, head section 16 and foot sections 50 and 52 can be adjusted to relieve pain, increase circulation, or the like for person 44.

By using chemical free materials for making adjustable bed 10, person 44 will be using an environmentally and personally safe bed. With the dangers of formaldehyde to a persons body, the elimination of the chemical from mattress platform 14 reduces the risks of illness to person 44. The use of chemical free plywood mattress platform 14, all natural latex or soy based foam for mattress 90 and deck foam 88, and all natural fiber materials for deck cover 94 and mattress cover 96 is key to the present invention in providing chemical free, environmentally safe adjustable bed 10.

While this invention has been described as having an exemplary design, the present invention may be further modified within the spirit and scope of this disclosure. This application is therefore intended to cover any variations, uses, or adaptations of the invention using its general principles.

What is claimed is:

1. An adjustable bed, comprising:

an adjustable bed frame having a first frame end, a second frame end and a pair of frame plates;

a single first actuator having opposite ends attached at one of said ends to said first frame end and a single second actuator having opposite ends attached at one of said ends to said second frame end;

a mattress platform having a head section, a center section, a first foot section and a second foot section, said center section fixedly secured to said frame plates of said adjustable bed frame, and a portion of said first foot section supported by said frame plates;

a pair of angle supports having a first and second end, said first end of said angle supports secured to said second frame end and said second end of said angle supports secured to said second foot section;

a first pair of head supports fixedly secured to said head section and a second pair of head supports fixedly secured to said center section, said first and second pairs of head supports pivotally connected, a first pair of foot supports fixedly secured to said first foot section and a second pair of foot supports fixedly secured to said second foot section, said first and second pairs of foot supports pivotally connected, said first actuator pivotally attached at one of said ends to said head supports and said second actuator pivotally attached at one of said ends to at least one of said foot supports said mattress platform is constructed from chemical free material, whereby said adjustable bed is environmentally safe.

2. The adjustable bed of claim 1 wherein said mattress platform is constructed from formaldehyde free plywood.

3. The adjustable bed of claim 2 wherein said formaldehyde free plywood is manufactured using soy glue.

4. The adjustable bed of claim 1 wherein said mattress platform is constructed from formaldehyde free medium density fiberboard.

5. The adjustable bed of claim 1 providing deck foam positioned atop said mattress platform, wherein said deck foam is all natural foam.

6. The adjustable bed of claim 5 wherein said deck foam is one of latex foam or soy based foam.

7. The adjustable bed of claim 5 wherein said deck foam is covered by a deck cover, said deck cover constructed from all natural fiber material.

8. The adjustable bed of claim 5 providing a mattress placed atop said deck foam, wherein said mattress is one of latex foam or soy based foam.

9. An adjustable bed, comprising:

an adjustable bed frame having a first frame end, a second frame end and a pair of frame plates;

a single first actuator having opposite ends attached at one of said ends to said first frame end and a single second actuator having opposite ends attached at one of said ends to said second frame end;

a mattress platform having a head section, a center section, a first foot section and a second foot section, said center section fixedly secured to said frame plates of said adjustable bed frame, and a portion of said first foot section supported by said frame plates;

a pair of angle supports having a first and second end, said first end of said angle supports secured to said second frame end and said second end of said angle supports secured to said second foot;

a first pair of head supports fixedly secured to said head section and a second pair of head supports fixedly secured to said center section, said first and second pairs of head supports pivotally connected, a first pair of foot supports fixedly secured to said first foot section and a second pair of foot supports fixedly secured to said second foot section, said first and second pairs of foot supports pivotally connected, said first actuator pivotally attached at one of said ends to said head supports and said second actuator pivotally attached at one of said ends to at least one of said foot supports said mattress platform is constructed from formaldehyde free plywood, whereby said adjustable bed is environmentally safe.

10. The adjustable bed of claim 9 wherein said formaldehyde free plywood is manufactured using soy glue.

11. The adjustable bed of claim 9 wherein said mattress platform is constructed from formaldehyde free medium density fiberboard.

12. The adjustable bed of claim 9 providing deck foam positioned atop said mattress platform, wherein said deck foam is all natural foam.

13. The adjustable bed of claim 12 wherein said deck foam is one of latex foam or soy based foam.

14. The adjustable bed of claim 12 wherein said deck foam is covered by a deck cover, said deck cover constructed from all natural fiber material.

15. The adjustable bed of claim 12 providing a mattress placed atop said deck foam, wherein said mattress is one of latex foam or soy based foam.

16. An adjustable bed, comprising:

an adjustable bed frame having a first frame end, a second frame end and a pair of frame plates;

a single first actuator having opposite ends attached at one of said ends to said first frame end and a single second actuator having opposite ends attached at one of said ends to said second frame end;

a mattress platform having a head section, a center section, a first foot section and a second foot section, said center section fixedly secured to said frame plates of said adjustable bed frame, and a portion of said first foot section supported by said frame plates;

a pair of angle supports having a first and second end, said first end of said angle supports secured to said second frame end and said second end of said angle supports secured to said second foot section;

a first pair of head supports fixedly secured to said head section and a second pair of head supports fixedly secured to said center section, said first and second pairs of head supports pivotally connected, a first pair of foot supports fixedly secured to said first foot section and a second pair of foot supports fixedly secured to said second foot section, said first and second pairs of foot supports pivotally connected, said first actuator pivotally attached at one of said ends to said head supports and said second actuator pivotally attached at one of said ends to at least one of said foot supports said mattress platform is constructed from chemical free material;

deck foam placed atop said mattress platform, said deck foam is all natural foam; and a deck cover positioned atop said deck foam, said deck cover is constructed from all natural fiber material, whereby said adjustable bed is environmentally safe.

17. The adjustable bed of claim 16 wherein said mattress platform is constructed from formaldehyde free plywood.

18. The adjustable bed of claim 17 wherein said formaldehyde free plywood is manufactured using soy glue.

19. The adjustable bed of claim 16 wherein said mattress platform is constructed from formaldehyde free medium density fiberboard.

20. The adjustable bed of claim 16 wherein said deck foam and said mattress is one of latex foam or soy based foam.

* * * * *